US009273686B2

(12) United States Patent
Andersen et al.

(10) Patent No.: US 9,273,686 B2
(45) Date of Patent: Mar. 1, 2016

(54) PRE-CHARGING PUMP CHAMBER BY PREEMPTIVELY OPENING A VALVE

(71) Applicant: Schlumberger Technology Corporation, Sugar Land, TX (US)

(72) Inventors: Cameron Andersen, Spanish Fork, UT (US); Jared Mangum, Lehi, UT (US); Mason L Garth, Springville, UT (US); Kenneth J Stoddard, Santaquin, UT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 289 days.

(21) Appl. No.: 13/749,685

(22) Filed: Jan. 25, 2013

(65) Prior Publication Data

US 2013/0195683 A1 Aug. 1, 2013

Related U.S. Application Data

(60) Provisional application No. 61/592,593, filed on Jan. 31, 2012.

(51) Int. Cl.

| | |
|---|---|
| ***F04B 43/00*** | (2006.01) |
| ***F04B 43/02*** | (2006.01) |
| ***F04B 43/067*** | (2006.01) |
| ***F04B 43/08*** | (2006.01) |

(52) U.S. Cl.

CPC ..... *F04B 43/02* (2013.01); *F04B 43/0009* (2013.01); *F04B 43/067* (2013.01); *F04B 43/08* (2013.01); *F04B 43/0072* (2013.01)

(58) Field of Classification Search

CPC .. F04B 43/0009; F04B 43/08; F04B 43/0072; F04B 43/10; F04B 43/107; F04B 45/033; F04B 45/0333; F04B 45/053; F04B 45/0533; F04B 45/073; F04B 45/0733; F04B 43/06; F04B 43/067; F04B 7/0069; F04B 7/0057; F04B 9/1053; F04B 9/105; F04B 9/1035

See application file for complete search history.

(56) References Cited

U.S. PATENT DOCUMENTS

| | | | | |
|---|---|---|---|---|
| 2,690,134 A | | 9/1954 | Ritche | |
| 3,254,607 A | * | 6/1966 | Norton | 417/460 |
| 4,907,953 A | * | 3/1990 | Hebert et al. | 417/444 |
| 5,261,798 A | * | 11/1993 | Budde | 417/393 |
| 2006/0008364 A1 | * | 1/2006 | Traylor | 417/395 |

OTHER PUBLICATIONS

Examination report for the equivalent Australian patent application No. 2013200474 issued on Dec. 20, 2013.

* cited by examiner

*Primary Examiner* — Bryan Lettman
(74) *Attorney, Agent, or Firm* — Michael Stonebrook

(57) ABSTRACT

A reciprocating pump with chamber-charging mechanism is provided. In an example diaphragm pump, a discharge valve can be opened by the pressure of fluid leaving the pump and can also be opened by an intermittent mechanical linkage actuated by the reciprocating member powering the pump. The discharge valve is mechanically opened to allow pressure backflow into the pumping chamber, thereby charging compressible fluid mixtures and gases with an increase in pressure. The increased pressure enables the compressible fluids to open the discharge valve on the next compression stroke and exit the pump. In an implementation, the discharge valve is pushed open by the reciprocating power source in a configuration that seals the valve mechanism from well fluid. In another implementation, the discharge valve is pulled open to pre-charge the pumping chamber.

17 Claims, 8 Drawing Sheets

PRE-CHARGING PUMP CHAMBER BY PREEMPTIVELY OPENING A VALVE

RELATED APPLICATIONS

This patent application claims the benefit of priority to U.S. Provisional Patent No. 61/592,593 to Andersen et al., filed Jan. 31, 2012 and entitled, "Pre-charging A Pump Chamber By Preemptively Opening A Valve," which is incorporated herein by reference in its entirety.

BACKGROUND

Some submersed fluid pumps have pumping action that is based on linear reciprocal motion. For example, diaphragm pumps may use a reciprocating hydraulic rod to displace fluid, which alternately inflates and deflates a diaphragm within the fixed volume of a pump casing. One-way inlet and discharge (outlet) valves take advantage of the changes in volume between the fixed casing and the expanding and contracting diaphragm to pump well fluid in desired flow paths. As the diaphragm deflates within the pumping chamber, an inlet check valve allows well fluid to enter the casing. Then, as the diaphragm inflates, the pressure is raised within the casing until the discharge check valve opens to allow the pumped well fluid out, for example, into an underground pipe conveying the well fluid to the surface. When compressible fluids (gases and gases-liquid mixtures) enter the pumping chamber, the reciprocating motion may be wasted compressing this kind of well fluid, and the compression obtained is not sufficient to open the discharge check valve and pump out the well fluid. This condition is referred to as "gas interference" or "gas lock."

SUMMARY

A reciprocating pump with chamber-charging mechanism is provided. In an implementation, an apparatus includes a pump for a well fluid, a reciprocating mover in the pump to alternately inflate and deflate a diaphragm within the pump, and an inlet valve to allow the well fluid to enter the pump when the diaphragm deflates. A discharge valve allows the well fluid to exit the pump when the diaphragm inflates, but is also utilized to charge a pumping chamber of the pump. An intermittent mechanical linkage between the reciprocating mover and the discharge valve enables pressure to backflow into the pump via the discharge valve at a point during the pump cycle. An example method establishes an intermittent mechanical linkage between a reciprocating mover of a pump and a discharge valve, and pressurizes a pump chamber by opening the discharge valve via the intermittent mechanical linkage. An example diaphragm pump includes a reciprocating mover, a pump chamber, and an inflatable diaphragm in the pump chamber in fluid communication with the reciprocating mover. An outlet check valve allows pumped fluid under pressure to open the outlet check valve and exit the pump chamber, but is also utilized to pre-charge the pump chamber. A valve stem on the outlet check valve opens the outlet check valve to pre-charge the chamber when the valve stem is mechanically moved by the reciprocating mover. This summary section is not intended to give a full description of a reciprocating pump with chamber-charging mechanism. A detailed description with example embodiments follows.

DETAILED DESCRIPTION

Overview

This disclosure describes reciprocating pumps that have chamber-charging mechanisms ("pre-chargers"). The charging mechanism may allow the use of diaphragm pumps in fluid that includes free gas or compressible fluid in the pumped well fluid medium. Horizontally drilled natural gas wells, for example, which have been hydraulically fractured and have many perforations, may require an artificial lift pump that can operate in near-horizontal orientation and pump gassy well fluid.

In order to prevent or to remedy gas lock, example reciprocating pumps described herein have an intermittent mechanical linkage established between a reciprocating member, such as the hydraulically powered rod that powers the pump ("reciprocating mover"), and a discharge valve that is conventionally opened only by pressure of the well fluid being pumped out. When the discharge valve is preemptively opened by the intermittent mechanical linkage, the compressible gas causing the gas lock is subjected to the full column-pressure (i.e., static fluid pressure) of the well fluid that has been previously pumped out of the discharge valve into a pipe leading to the surface, for example. This mechanically-induced valve opening thus allows a backflow of pressure (pressurized fluid from outside of the pump) back into the pump via the discharge valve. The backflow pressurizes the "trapped" compressible well fluid (gas) within the pump chamber with extra external pressure—i.e., the pressurized backflow charges the interior of the pump chamber to a higher pressure. Then, on the next pump cycle, the compressible well fluid inside the pump is at high enough pressure to open the discharge valve of its own accord and exit the pump under the additional pressure provided by the reciprocal mover on this next pump stroke.

In various implementations of example diaphragm pumps, the discharge valve can be timed to open by mechanical intervention at different points in the reciprocation cycle, depending on the style of pump and the action desired.

Features, systems, and methods associated with reciprocating pumps that have a chamber-charging mechanism represent possible implementations and are included for illustration purposes and should not be construed as limiting. Moreover, it will be understood that different implementations can include all or different subsets of aspects described below. Furthermore, the aspects described below may be included in any order, and numbers and/or letters placed before various aspects are done for ease of reading and in no way imply an order, or level of importance to their associated aspects.

Example Apparatus

Figure 1:
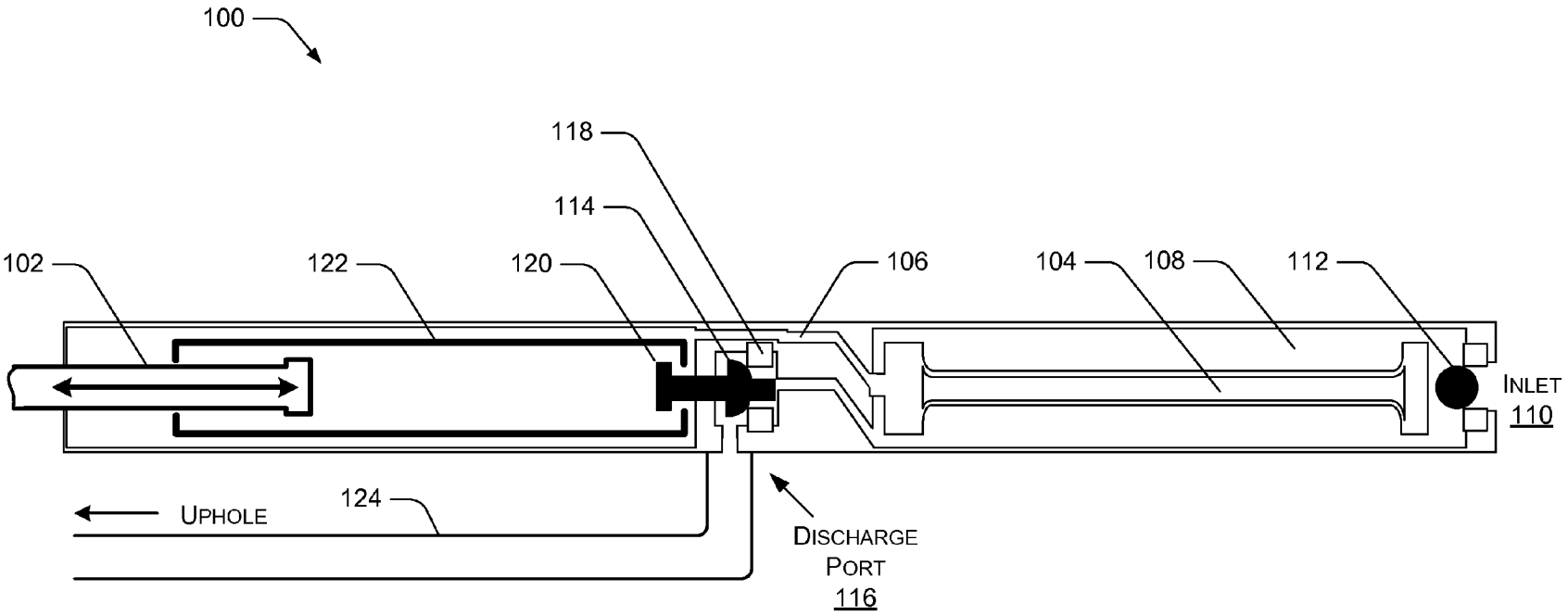
FIG. 1 is a diagram of an example reciprocating pump that includes a chamber-charging mechanism.

FIG. 1 shows an example reciprocating pump 100. The reciprocating pump 100 has a reciprocating mover 102, such as a hydraulic rod, which displaces pump fluid (operating fluid) that is in fluid communication with a diaphragm 104 via a fluid channel 106. The diaphragm 104 expands and contracts as it is inflated and deflated with the displaced pump fluid. When the diaphragm 104 contracts, a pump chamber 108 surrounding the diaphragm 104 is filled with well fluid from outside the pump 100 flowing in through an inlet 110 and via an inlet check valve 112.

The example reciprocating pump 100 has a discharge valve 114 that is also a pre-charger used for charging the pump chamber 108 with an increase in pressure. Contraction of the diaphragm 104 causes a "vacuum" in the pump chamber 108 that tends to suck the discharge valve 114 into a closed position during a filling phase of the pump chamber 108 when well fluid is being let in. Pressure on the external side of the discharge valve 114 also pushes the discharge valve 114 closed when well fluid is no longer being pushed out of the pump chamber 108.

When the diaphragm 104 expands, pressure in the pump chamber 108 increases, closing the inlet check valve 112. The same increasing pressure in the pump chamber 108 opens the discharge valve 114 and allows the well fluid being pumped to leave the pump 100 via a discharge port 116. When there is compressible fluid such as gas in the pump chamber 108, however, the expanding diaphragm 104 may perform work compressing the gas, but the compressed gas may not have enough pressure to open the discharge valve 114. This results in a gas lock scenario, in which the pump 100 moves little or no well fluid through its pump chamber 108.

In an implementation, the example diaphragm pump 100 has a discharge valve 114 that is axially in line with the reciprocating mover 102. The discharge valve 114 has a hemispherical valve disk that closes against a valve seat 118 when the valve stem moves away from the reciprocating mover 102. The end of the valve stem nearest the reciprocating mover 102 may be threaded to accommodate a tappet or other stop 120. A tube 122 or other mechanical linkage is constructed so that when the reciprocating mover 102 nears the end of its retraction stroke, the reciprocating mover 102 contacts and pulls a first end of the tube 122 causing other end of the tube 122 to pull the discharge valve 114 open.

The discharge valve 114 is thus mechanically actuated at the end of the filling cycle of the pump chamber 108. If the pump chamber 108 has just let in a compressible fluid mixture, or perhaps pure gas, the mechanical opening of the discharge valve 114 subjects the newly filled pump chamber 108 to the higher static fluid pressure of the fluid outside the discharge port 116. The fluid outside the discharge port 116 may be in a tube, discharge pipe 124, or annulus leading to the surface and under considerable pressure. Or, the fluid in the discharge pipe 124 or annulus outside the discharge port 116 may be directed elsewhere than the surface, but the fluid being pumped is under force of pressure (or else it would not need to be pumped). This external fluid pressure is higher than that of a compressible fluid newly let into the pump chamber 108. The pipe 124 is shown with a separation space between the pipe 124 and the pump 100 for illustrative purposes, but in an actual device the pump 100 and its discharge vessels all fit into a form factor suitable for the wellbore.

The open discharge valve 114 at this point in the pumping cycle allows a backflow of the outside pressure back into the pump chamber 108 through the discharge valve 114 charging whatever contents are in the pump chamber 108 with the same pressure as outside the discharge port 116, and pre-compressing the compressible fluid in the pump chamber 108 nearer to a pressure necessary to open the discharge valve 114 during the next pumping stroke. Thus, the pressure of the pump chamber 108 is equalized with the pressure of the fluid outside the discharge port 116. The reciprocating mover 102 then reverses motion and begins to extend, thereby discontinuing its pull on the tube 122 and allowing the discharge valve 114 to close. The reciprocating mover 102 proceeds to add pressure to the pump chamber 108 by forcing operating fluid into the diaphragm 104. Since the pump chamber 108 has just been charged to a pressure equal to the pressure outside the discharge port 116, the additional pressure now added by the reciprocating mover 102 exceeds the outside pressure thereby opening the discharge valve 114 and causing the compressible fluid to be pumped out of the pump 100.

Figure 2:
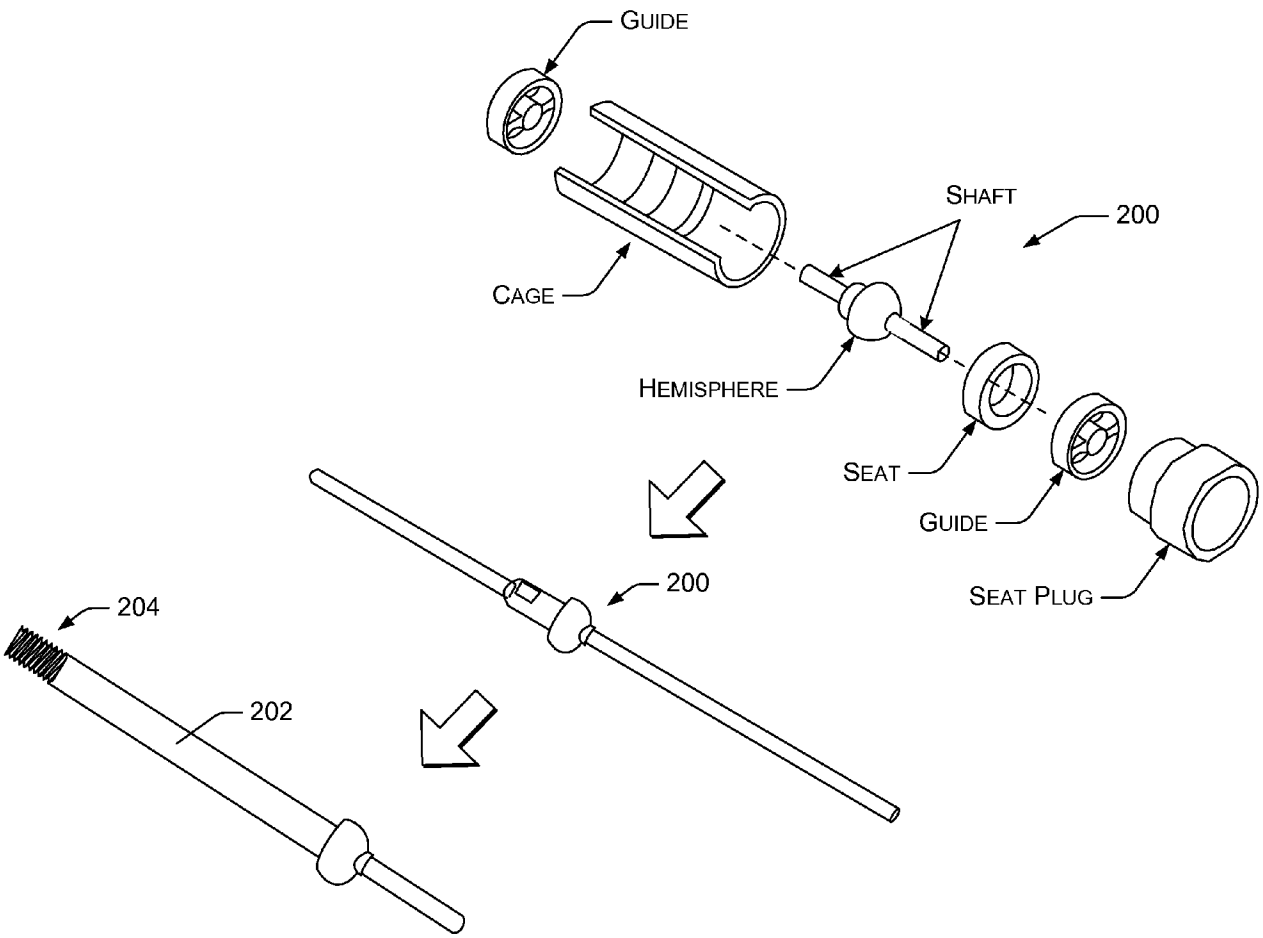
FIG. 2 is a diagram of an example technique for constructing pre-charger/discharge valve components.

FIG. 2 shows an example technique for constructing elements of the chamber-charging mechanism (pre-charger) and discharge valve 114. A conventional check valve, such as a hemispherical ball valve on a shaft or stem may be used as a starting component. The conventional check valve, such as a FLOWTEK gas breaker traveling valve, may be modified to create an example discharge valve element (Flowtek Industries, Houston, Tex.). The conventional traveling check valve can be modified by changing the length of stem elements as needed to fit the geometry and particular valve guides of the given example diaphragm pump 100, and by strengthening or thickening the stem shaft 202 where the stem shaft is to be pulled by the reciprocating mover 102. The strengthened end may be threaded 204 to receive a tappet or stop 120, which the intermittent mechanical linkage uses to pull open the discharge valve 114.

Figure 3:
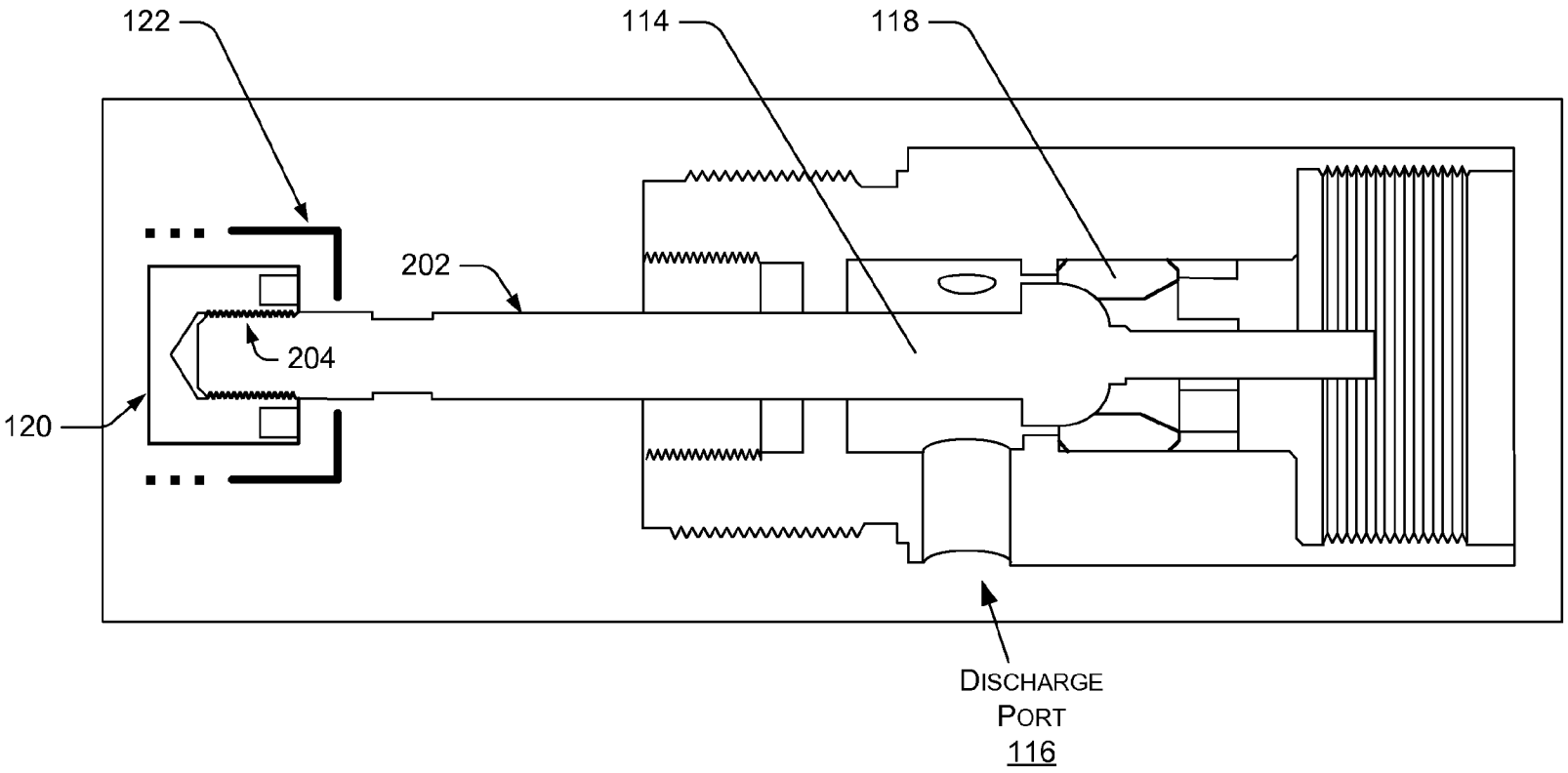
FIG. 3 is a diagram of an example pre-charger/discharge valve assembly, in which the discharge valve is pulled open.

FIG. 3 shows another view of the example discharge valve 114 suitable for being mechanically pulled open by an intermittent mechanical linkage actuated by the reciprocating mover 102.

Figure 4:
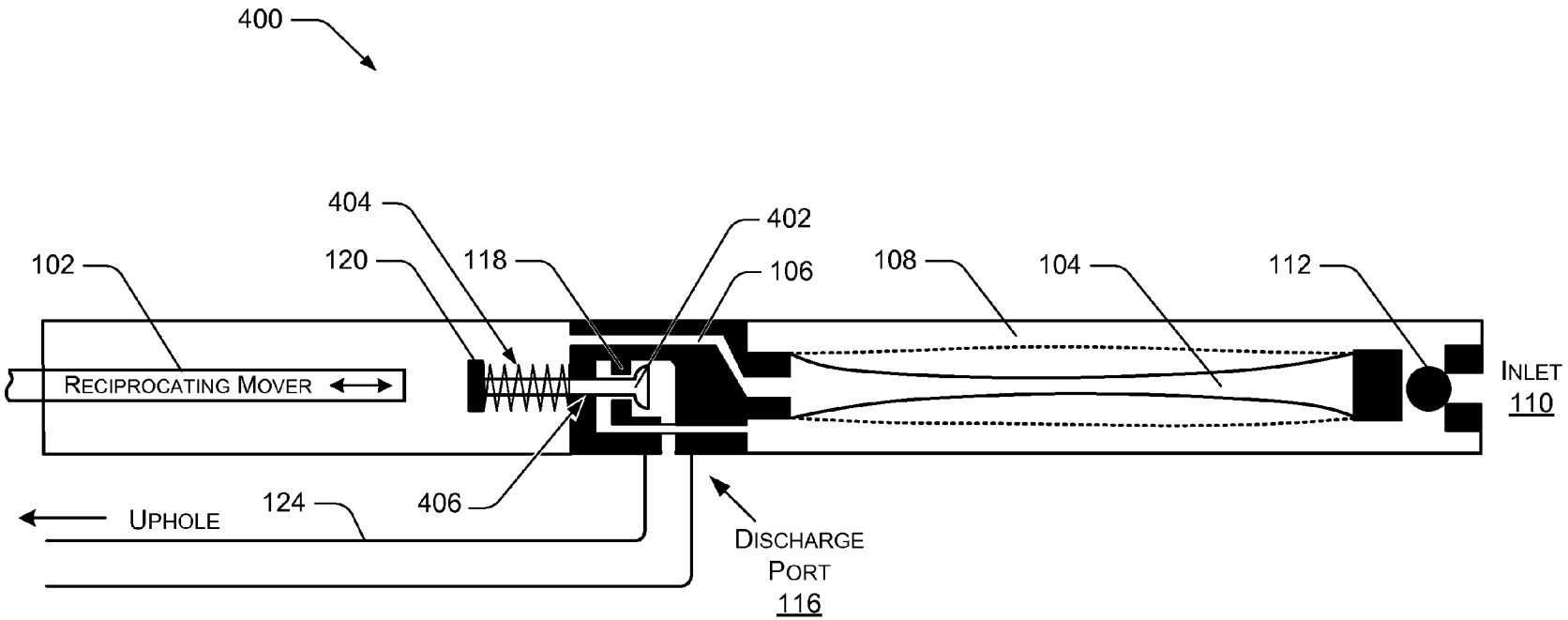
FIG. 4 is a diagram of a second example reciprocating pump with a chamber-charging mechanism.

FIG. 4 shows another implementation of an example reciprocating pump 400. In this implementation, a discharge valve 402 also functioning as a pre-charger for the pump chamber 108 is oriented in a direction of axial travel that is opposite to that of the discharge valve 114 shown in FIG. 1. Similar to the discharge valve 114 in FIG. 1, the example discharge valve 402 can open either when mechanically actuated or with a pressure difference across the valve 402. In this case, the example discharge valve 402 is pushed open by the reciprocating mover 102 at a maximum extension of the reciprocating mover 102 instead of being pulled open by the reciprocating mover 102 at a minimum extension of the reciprocating mover 102, as in FIG. 1.

In FIG. 4, the reciprocating pump 400 has a reciprocating mover 102 displacing an operating fluid that is in fluid communication via a fluid channel 106 with a diaphragm 104. The diaphragm 104 expands and contracts as it is inflated and deflated with the displaced operating fluid. When the diaphragm 104 contracts, the pump chamber 108 surrounding the diaphragm 104 is filled with well fluid from outside the pump 100 flowing in via the inlet 110 through the inlet check valve 112. Contraction of the diaphragm 104 also helps to suck the discharge valve 402 into a closed position, as the pump chamber 108 is filling with well fluid. In this implementation, the discharge valve also has a spring 404 to reinforce closure of the discharge valve 402 against various forces that could keep the discharge valve 402 open at the wrong time, such as valve sticking (seal friction), gravity acting on the valve parts and tending to pull the valve open due to slight weight, and ambiguous pressures of compressible fluids in the pump chamber 108, which may push against the discharge valve 402 but not cleanly snap the discharge valve 402 open.

When the diaphragm 104 expands, pressure in the pump chamber 108 increases, closing the inlet check valve 112. The same increasing pressure in the pump chamber 108 opens the discharge valve 402 when incompressible well fluid is present and allows the well fluid being pumped to leave the pump 400 via the discharge port 116. When there is compressible fluid such as gas in the pump chamber 108, however, the expanding diaphragm 104 may perform work compressing the gas, but the compressed gas may not have enough pressure to open the discharge valve 402. This results in a gas lock scenario, in which the pump 400 produces little or no well fluid.

In this implementation, the discharge valve 402 has a hemispherical disk on a traveling stem shaft and is situated so that the discharge valve 402 closes against a valve seat 118 when the valve stem moves toward the reciprocating mover 102. The discharge valve 402 opens when the valve stem travels away from the direction of the reciprocal mover 102. The end of the valve stem nearest the reciprocating mover 102 may be threaded to accommodate a tappet or other stop 120. When the reciprocating mover 102 nears its maximum extension, the reciprocating mover 102 itself contacts (indexes, pokes) the stem of the discharge valve 402 via the tappet or stop 120. This compresses the spring 404 and opens the discharge valve 402.

In this implementation, the discharge valve 402 is thus mechanically actuated to open at the end of the emptying cycle of the pump chamber 108, when the diaphragm 104 is at maximum inflation. However, if the pump chamber 108 contains appreciable compressible fluid mixture (e.g., gas) then the pumping action of the diaphragm 104 may have compressed the compressible fluid, but to a pressure insufficient to expel the compressible fluid from the pump chamber 108. The compressible fluid may still be in the pump chamber 108, although confined in a smaller volume since it is compressed.

The mechanical opening of the discharge valve 402 at this point in the pumping cycle subjects the "leftover" compressible fluid remaining in the pump chamber 108 to a higher static fluid pressure of the fluid outside the discharge port 116. Thus, opening the discharge valve 402 at this point in the pumping cycle allows a backflow of the outside pressure back into the pump chamber 108 charging whatever contents are in the pump chamber 108 with the same higher pressure as exists outside the discharge port 116, and adding to any compressive pressure in the pump chamber 108 imparted by the expanded diaphragm 104. Even though the reciprocating mover 102 retracts at this point, deflating the diaphragm 104, the compressible fluid in the pump chamber 108 has been charged with a higher pressure than it had before, and so the pressure to be imparted on the compressible fluid by the next compression stroke of the reciprocal mover 102 will be additive to the charging pressure accumulated when the discharge valve 402 was mechanically opened. The compressible fluid in the pump chamber 108 will have enough pressure to open the discharge valve 402 and exit the pump 400 on the next pumping cycle, since the act of mechanically opening the discharge valve 402 equalized the pressure inside the pump chamber 108 with the pressure on the discharge side of the discharge valve 402. The pressure from the next expansion of the diaphragm 104 during the next pump stroke is additive.

The example discharge valve 402 may also include at least one seal 406, which isolates the mechanical action of the discharge valve 402 from the well fluid. This is a beneficial feature because the well fluid may be adverse to free travel of the discharge valve 402 due to gas, corrosives, solvents, and/or particulates in the well fluid.

Figure 5:
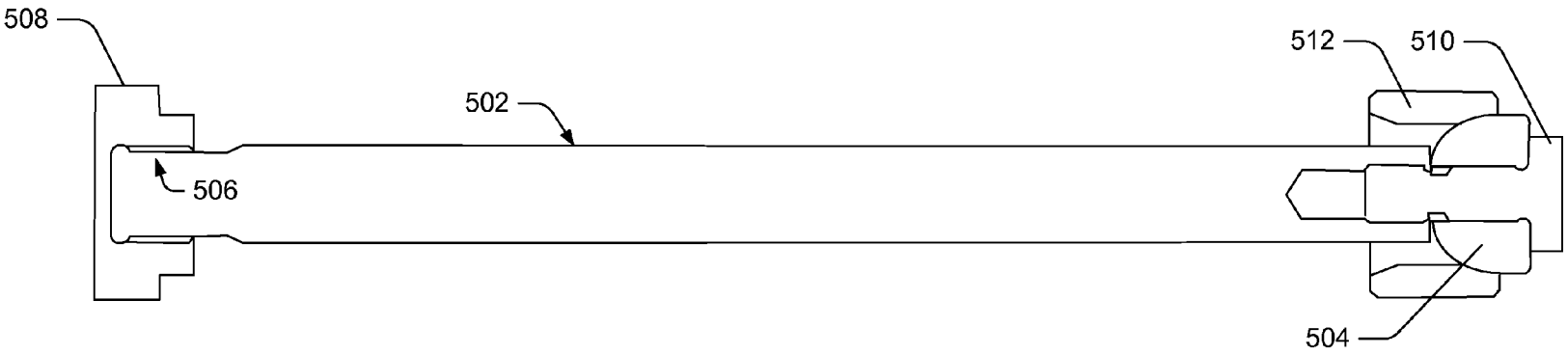
FIG. 5 is a diagram of example components of an example pre-charger/discharge valve.

FIG. 5 shows some example valve components of the example discharge valve 402. A shaft 502 may have a hemispherical ball (valve disk) section 504 attached. One end 506 of the shaft 502 may possess a male thread or other suitable feature allowing a tappet or stop 508 to be attached. The other end of the shaft 502 may be replaced with a retention bolt 510. The hemispherical valve disk engages a seat 512, forming a line-seal, preventing the passage of fluid through the example discharge valve 402.

Figure 6:
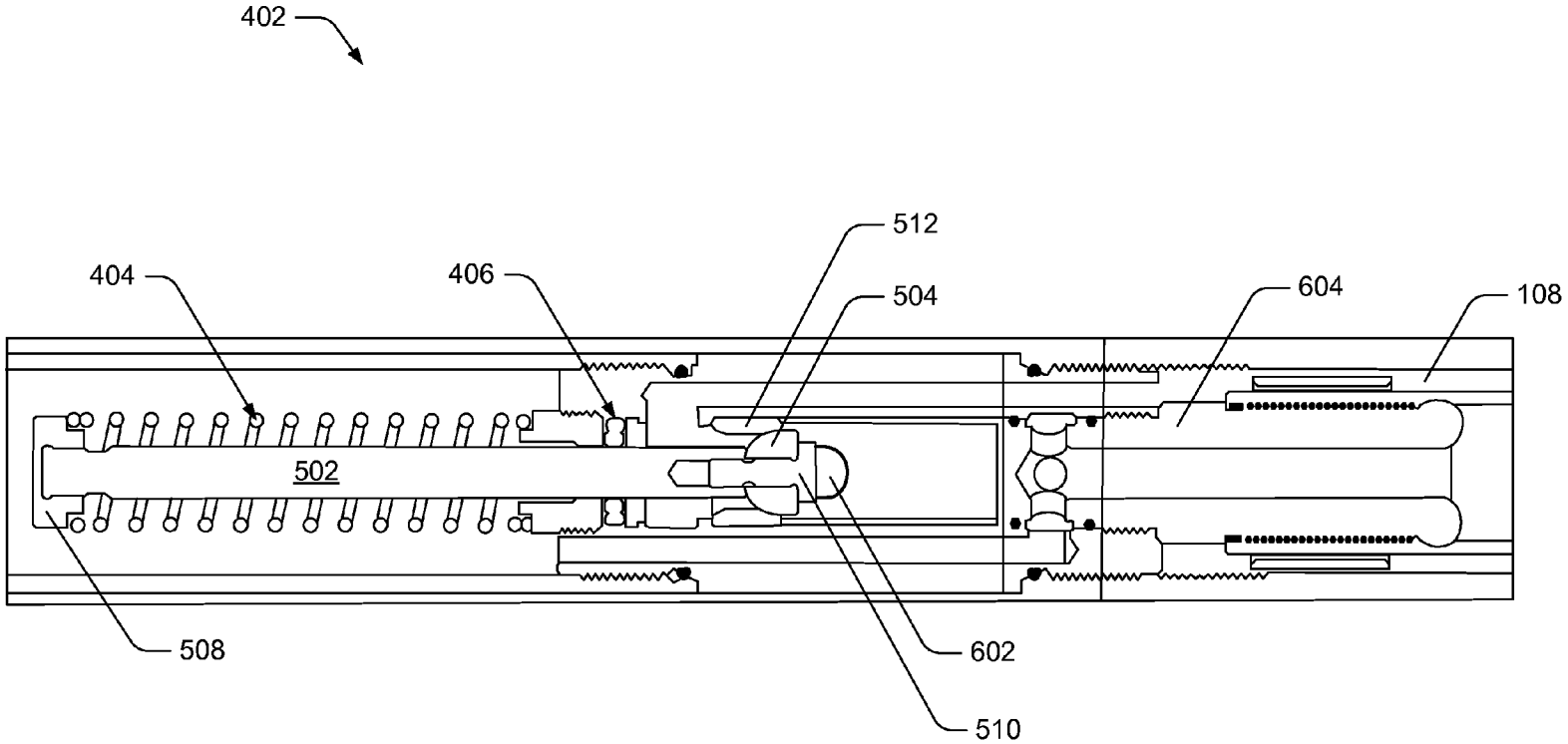
FIG. 6 is a diagram an example pre-charger/discharge valve assembly, in which the discharge valve is pushed open.

FIG. 6 shows another view, shown in an example context, of the example pre-charger and discharge valve 402 that can be opened by a pressure differential across the discharge valve 402 or by an intermittent mechanical linkage. The components shown include the hemispherical ball valve 504, the valve seat 512, and retaining bolt 510. The valve stem shaft 502 has a tappet 508 attached to the end which is intermittently struck by the reciprocating mover 102. A restore spring 404 applies force to keep the discharge valve 402 closed. The restore spring 404 and most of the valve stem shaft 502 are isolated from well fluid by the shaft seal 406. A discharge port 602 is also shown as well as a diaphragm pedestal 604. The pre-charger/discharge valve 402 is opened by the reciprocating mover 102 applying force to the tappet 508. High pressure fluid then enters side ports and flows through the open valve 504 and valve seat 512 to raise the pressure of fluid in the pumping chamber 108.

Figure 7:
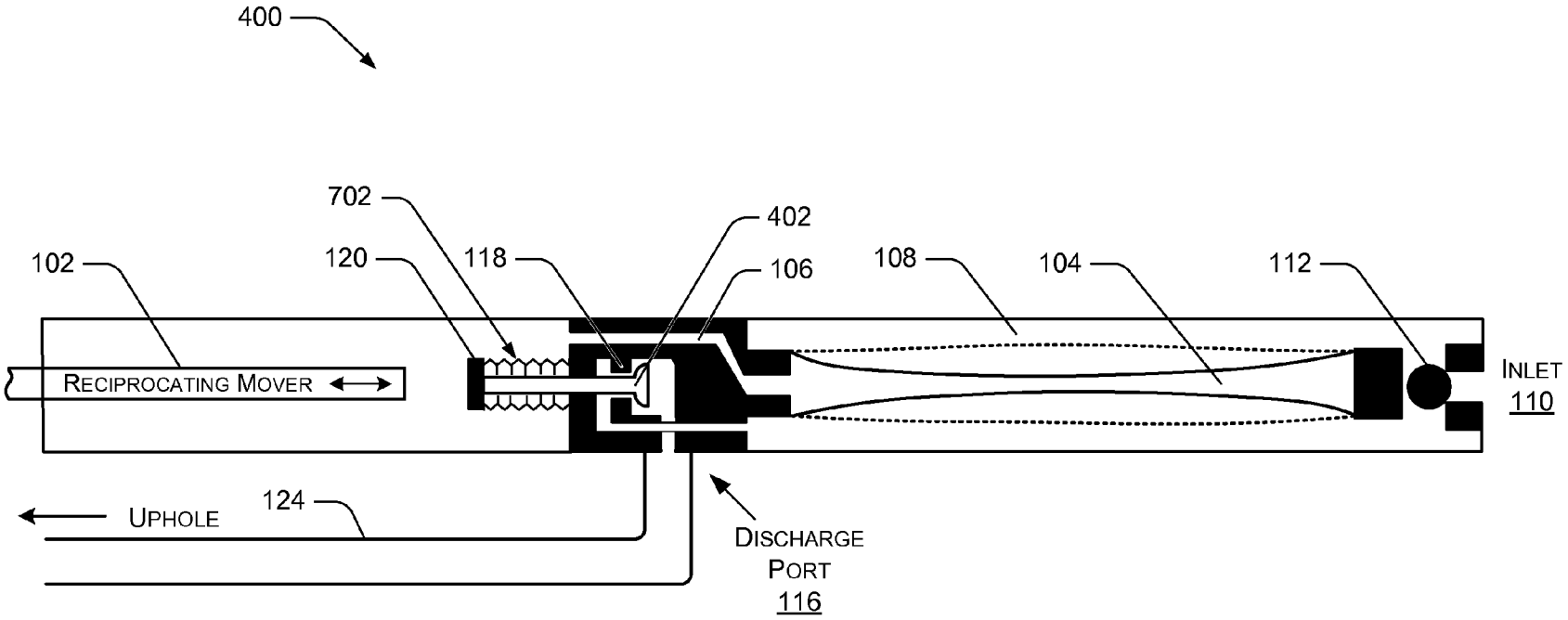
FIG. 7 is a diagram of an example reciprocating pump with a bellows around part of the pre-charger/discharge valve to separate operating fluid from well fluid during operation.

FIG. 7 shows an alternative implementation similar to that shown in FIG. 4. In FIG. 7, the spring 404 (FIG. 4) is replaced with a bellows 702, which allows the discharge valve 114 to reciprocate during its valve action, while keeping an operating fluid of the pump 400 separate from a well fluid being pumped without the sliding friction interface characteristic of a seal 406. The bellows 702 may replace both the spring 404 and the seal 406. The bellows 702 may also be biased with spring-like characteristics of a compression spring 404 so that the bellows 702 has a slight bias in neutral pressure state to push the discharge valve 114 into a closed valve position.

Example Method

Figure 8:
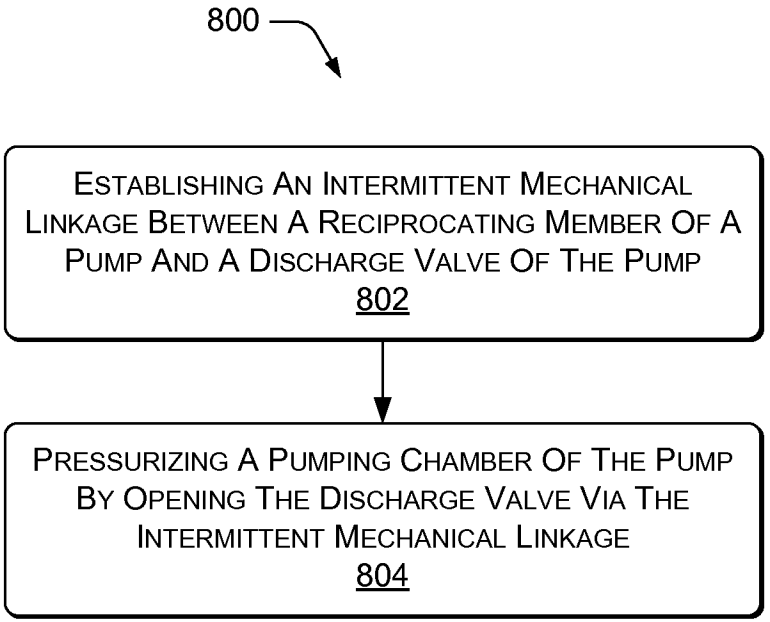
FIG. 8 is a flow diagram of an example method of charging a pump chamber of an example reciprocating pump.

FIG. 8 shows an example method 800 of charging a pump chamber of a reciprocating pump. In the flow diagram, operations are shown in individual blocks. The method 800 may be performed by hardware such as the diaphragm pumps 100 and 400 and the pre-charger/discharge valves 114 and 402.

At block 802, an intermittent mechanical linkage is established between a reciprocating member of a pump and a discharge valve of the pump.

At block 804, a pump chamber of the pump is pressurized by opening the discharge valve via the intermittent mechanical linkage. Opening the discharge valve to perform a backflow of pressure back into the pump chamber charges the pump chamber with a higher pressure for the next pump stroke. This can relieve gas lock and resolve difficulties inherent in pumping compressible fluids that include gases.

Conclusion

Although only a few example embodiments have been described in detail above, those skilled in the art will readily appreciate that many modifications are possible in the example embodiments without materially departing from the subject matter. Accordingly, all such modifications are intended to be included within the scope of this disclosure as defined in the following claims. In the claims, means-plus-function clauses are intended to cover the structures described herein as performing the recited function and not only structural equivalents, but also equivalent structures. It is the express intention of the applicant not to invoke 35 U.S.C. §112, paragraph 6 for any limitations of any of the claims herein, except for those in which the claim expressly uses the words 'means for' together with an associated function.

The invention claimed is:

1. An apparatus, comprising:

a pump for a well fluid;

a reciprocating mover in the pump to alternately inflate and deflate a diaphragm within the pump;

an inlet valve to allow the well fluid to enter the pump when the diaphragm deflates;

a discharge valve to allow the well fluid to exit the pump when the diaphragm inflates;

an intermittent mechanical linkage between the reciprocating mover and the discharge valve;

wherein the intermittent mechanical linkage causes a pressure backflow of a well fluid from outside the pump into the pump via the discharge valve;

wherein the mechanical linkage causes the pressure backflow from outside the pump during a maximum extension of the reciprocating mover; and wherein the increased pressure from outside the pump and an inflation of the diaphragm and resulting from the maximum extension of the reciprocating mover charges a pumping chamber of the pump during a reciprocation of the reciprocating mover.

2. The apparatus of claim 1, wherein the intermittent mechanical linkage pushes the discharge valve open.

3. The apparatus of claim 2, wherein the intermittent mechanical linkage pushes the discharge valve open at the maximum extension of the reciprocal mover by a direct contact between the reciprocating mover and the discharge valve.

4. The apparatus of claim 3, further comprising a spring to maintain the discharge valve in a closed state until the discharge valve is opened by the intermittent mechanical linkage or by the well fluid exiting the pump.

5. The apparatus of claim 1, further comprising a seal for preserving at least a valve guide of the discharge valve from the well fluid being pumped to protect a movement of the valve from the well fluid, wherein the well fluid contains one of a gas, a corrosive, a solvent, or a particulate.

6. The apparatus of claim 1, further comprising a seal for preserving the intermittent mechanical linkage from the well fluid being pumped to protect the intermittent mechanical linkage from the well fluid, wherein the well fluid contains one of a gas, a corrosive, a solvent, or a particulate.

7. The apparatus of claim 1, further comprising a bellows for allowing a reciprocation of the discharge valve while keeping an operating fluid of the pump separate from a well fluid being pumped without a sliding friction interface.

8. A method comprising:

establishing an intermittent mechanical linkage between a reciprocating mover of a diaphragm pump and a discharge valve of the diaphragm pump;

opening the discharge valve during a maximum extension of the reciprocating mover via the intermittent mechanical linkage to cause a pressure backflow from outside the diaphragm pump into the diaphragm pump; and pressurizing a pump chamber of the diaphragm pump with an increased pressure from a combination of the pressure backflow from outside the pump and a maximum inflation of a diaphragm of the diaphragm pump and resulting from the maximum extension of the reciprocating mover.

9. The method of claim 8, wherein the intermittent mechanical linkage pushes the discharge valve open.

10. The method of claim 8, further comprising sealing at least a valve guide of the discharge valve from a well fluid being pumped to protect a movement of the valve from the well fluid, wherein the well fluid contains one of a gas, a corrosive, a solvent, or a particulate.

11. The method of claim 8, further comprising sealing the intermittent mechanical linkage from the well fluid being pumped to protect the intermittent mechanical linkage from the well fluid, wherein the well fluid contains one of a gas, a corrosive, a solvent, or a particulate.

12. The method of claim 8, wherein pressurizing the pump chamber of the diaphragm pump by opening the discharge valve via the intermittent mechanical linkage enables the pressure backflow into the diaphragm pump via the discharge valve by direct contact between the reciprocating mover and the discharge valve.

13. A diaphragm pump, comprising:

a reciprocating mover;

a pump chamber;

an inflatable diaphragm in the pump chamber in fluid communication with the reciprocating mover;

an outlet check valve to allow a pumped well fluid to open the outlet check valve and exit the pump chamber; and a valve stem on the outlet check valve to open the outlet check valve during a maximum extension of the reciprocating mover and during an inflation of a diaphragm of the diaphragm pump, wherein the valve stem is mechanically moved by the reciprocating mover; and wherein the maximum extension of the reciprocating mover to pre-charges the pump chamber with an increased pressure from the pumped well fluid outside the pump and the inflation of the diaphragm and resulting from the maximum extension of the reciprocating mover.

14. The diaphragm pump of claim 13, wherein the valve stem is slidably disposed in an axial alignment with the reciprocating mover to open the outlet check valve when the reciprocating mover pushes the valve stem.

15. The diaphragm pump of claim 13, further comprising a tappet connected to the valve stem, wherein the reciprocating mover contacts the tappet near the maximum extension of the reciprocating mover during a pump cycle.

16. The diaphragm pump of claim 13, further comprising a spring to maintain the outlet check valve in a closed state until the outlet check valve is opened by a mechanical push from the reciprocating mover or by the well fluid exiting the pump.

17. The diaphragm pump of claim 16, further comprising at least one seal to isolate at least a slidable mount of the outlet check valve and the spring from the well fluid, wherein the well fluid contains one of a gas, a corrosive, a solvent, or a particulate.

* * * * *

UNITED STATES PATENT AND TRADEMARK OFFICE

CERTIFICATE OF CORRECTION

PATENT NO. : 9,273,686 B2
APPLICATION NO. : 13/749685
DATED : March 1, 2016
INVENTOR(S) : Cameron Andersen et al.

It is certified that error appears in the above-identified patent and that said Letters Patent is hereby corrected as shown below:

Title Page, item (72) Third inventor's Name:
Change "Mason L. Garth" to --Garth L. Mason--

Signed and Sealed this
Twenty-first Day of June, 2016

Michelle K. Lee

Michelle K. Lee
*Director of the United States Patent and Trademark Office*